US005412460A

United States Patent [19]

Okazaki et al.

[11] Patent Number: 5,412,460

[45] Date of Patent: May 2, 1995

[54] IMAGE TRANSFER UNIT FOR IMAGE FORMING APPARATUS

[75] Inventors: Noritaka Okazaki; Ryuji Wataki; Eiji Nimura; Michio Uchida; Yuki Ito, all of Osaka, Japan

[73] Assignee: Mita Industrial Co., Ltd., Japan

[21] Appl. No.: 128,246

[22] Filed: Sep. 29, 1993

[30] Foreign Application Priority Data

Oct. 20, 1992 [JP] Japan ..... 4-281498

[51] Int. Cl.[6] ..... G03G 15/16

[52] U.S. Cl. ..... 355/274; 355/277

[58] Field of Search ..... 355/271, 274, 277, 273

[56] References Cited

U.S. PATENT DOCUMENTS

| | | | |
|---|---|---|---|
| 3,830,589 | 8/1974 | Allen | 355/274 |
| 4,171,899 | 10/1979 | Yanagawa et al. | 355/274 |
| 4,571,052 | 2/1986 | Shirai | 355/274 |
| 5,081,501 | 1/1992 | Waki et al. | 355/274 |
| 5,198,863 | 3/1993 | Goto et al. | 355/274 |
| 5,227,851 | 7/1993 | Yoshida et al. | 355/271 |

FOREIGN PATENT DOCUMENTS

| | | | |
|---|---|---|---|
| 0173078 | 7/1988 | Japan | 355/274 |

*Primary Examiner*—A. T. Grimley
*Assistant Examiner*—Robert Beatty
*Attorney, Agent, or Firm*—Beveridge, DeGrandi, Weilacher & Young

[57] ABSTRACT

A transfer plate which also serves as a sheet guide plate is pushed by a torsion spring. A minimum gap less than 0.2 mm between a guide surface of the transfer plate and the surface of a photoreceptor drum is maintained to be smaller than the thickness of a transfer sheet by a spacer member provided on the guide surface. When the sheet passes through the gap between the drum surface and the guide surface, the transfer plate is pushed down by the sheet and the sheet is pressed onto a toner image formed on the drum surface with an appropriate pressure by the pushing force of the torsion spring. At this time, a transfer voltage is applied to the transfer plate, so that the toner image on the drum surface is transferred to the sheet.

13 Claims, 4 Drawing Sheets

IMAGE TRANSFER UNIT FOR IMAGE FORMING APPARATUS

BACKGROUND OF THE INVENTION

1. Field of the Invention

The present invention relates to a transfer unit incorporated in an image forming apparatus such as an electronic copying apparatus, a printer apparatus and a facsimile apparatus, said transfer unit being for transferring to a transfer sheet a toner image formed on a surface of a photoreceptor incorporated in the image forming apparatus.

2. Description of the Prior Art

In copying apparatuses, the following two types have generally been used as transfer units for transferring to a transfer sheet a toner image formed on the surface of a photoreceptor drum: a non-contact-type transfer unit employing a corona transfer method using a corona discharger; and a contact-type transfer unit employing a bias roller transfer method using a conductive roller.

In a conventional transfer unit of the type employing the corona transfer method, as schematically shown in FIG. 1, a corona discharger 22 is arranged at a necessary distance from a photoreceptor drum 21 rotated in one direction. A transfer sheet P fed into a gap between the drum 21 and the corona discharger 22 is in contact with a toner image formed on a drum surface. By charging the sheet P through the application of a corona charge of a polarity reverse to that of the toner from the reverse surface side of the sheet P, the sheet P adheres to the drum surface, and by Coulomb's force, the toner on the drum surface is transferred to the sheet P.

In a conventional transfer unit of the type employing the bias roller transfer method, as schematically shown in FIG. 2, a conductive roller 23 is arranged to be rotatively in contact with the photoreceptor drum 21 rotated in one direction. The transfer sheet P is pressed onto the toner on the drum surface by the roller 23, and the transfer of the toner is performed by applying to the roller 23 a transfer voltage of a polarity reverse to that of the toner.

In recent years, copying apparatuses and facsimile apparatuses have largely been required to be downsized. To meet these demands, it is necessary to develop a space-saving transfer unit. However, with the conventional transfer units employing the above-described two transfer methods which require a large space for their paper feeding paths because of its structure, the size reduction of the apparatuses is limited.

Specifically, in the case of the conventional transfer unit of FIG. 1 employing the corona transfer method, since it is difficult to reduce the size of a shield case 22*a* constituting the shell of the corona discharger 22 because of its structure and since it is necessary to arrange the corona discharger 22 at a distance from the drum 21, it is difficult to reduce the space occupied by the entire transfer unit. Moreover, in this case, since the corona transfer method is of the non-contact type, it is necessary to apply a high voltage to the discharger, which results in the generation of ozone that is harmful to human body.

In the case of the conventional transfer unit of FIG. 2 employing the bias roller transfer method, since it is necessary for the conductive roller 23 to be of a type capable of pressing the sheet P onto the drum surface with no gap therebetween over the entire image area of an axis direction of the drum, the reduction of its diameter is naturally limited. Moreover, since the roller 23 is in direct contact with the drum surface when no sheet is present therebetween, it is readily contaminated by the toner, which necessitates a means for cleaning the roller 23. For these reasons, this transfer unit requires a considerably large space.

SUMMARY OF THE INVENTION

An object of the present invention is to provide a small-size transfer unit requiring no high voltage and where toner contamination hardly occurs.

A transfer unit of the present invention is provided with a transfer plate including a guide surface with which a transfer sheet fed in one direction is slidingly in contact, said transfer plate being arranged so that said guide surface is opposite to a surface of a photoreceptor, pushing means for always pushing said transfer plate toward the surface of the photoreceptor, gap maintaining means for preventing, against a pushing force of said pushing means, a contact of said transfer plate with the surface of the photoreceptor, said gap maintaining means maintaining a minimum gap between the transfer plate and the surface of the photoreceptor to be smaller than a thickness of the transfer sheet, and voltage supplying means for supplying a transfer voltage to the transfer plate at least when the transfer sheet passes through the gap between the transfer plate and the surface of the photoreceptor.

According to such a feature, a toner image is transferred to the transfer sheet while the transfer sheet is passing through the gap between the photoreceptor and the transfer plate arranged to be opposite thereto. While the sheet is passing, the transfer plate is pushed down by the sheet against the pushing force of the pushing means and the sheet is pressed onto the toner image formed on the drum surface with an appropriate pressure by the pushing force of the pushing means. Since the transfer voltage is being applied to the transfer plate from the voltage supplying means at this time, the toner image is separated from the photoreceptor and transferred to the sheet. After the transfer sheet has passed through the gap between the photoreceptor and the transfer plate, the transfer plate is again pushed up toward the drum surface by the pushing force of the pushing means. At this time, however, by the gap maintaining means, the guide surface of the transfer plate is maintained at a position where a gap which is smaller than the thickness of the sheet is left between the transfer plate and the photoreceptor surface so that the transfer plate is out of contact with the photoreceptor surface. Since the transfer plate is out of contact with the photoreceptor surface even when no sheet is present in the gap, the transfer plate is never contaminated by the toner.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
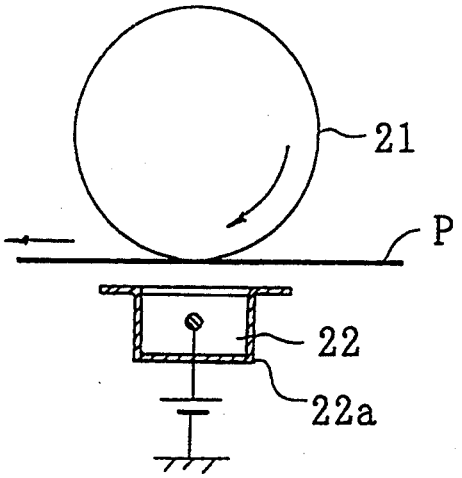
Fig. 1 Prior Art
FIG. 1 is a schematic front view of a conventional transfer unit employing a corona transfer method.
Figure 2:
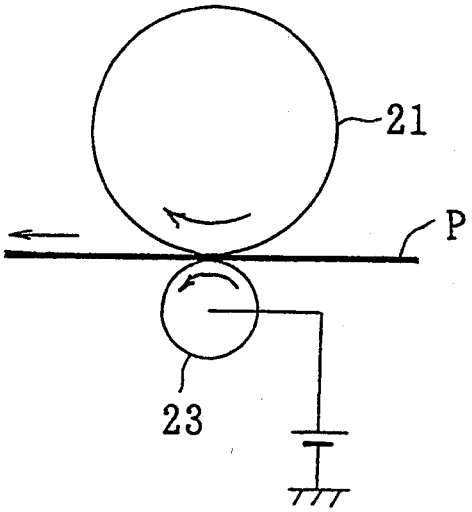
Fig. 2 Prior Art
FIG. 2 is a schematic front view of a conventional transfer unit employing a bias roller transfer method.
Figure 3:
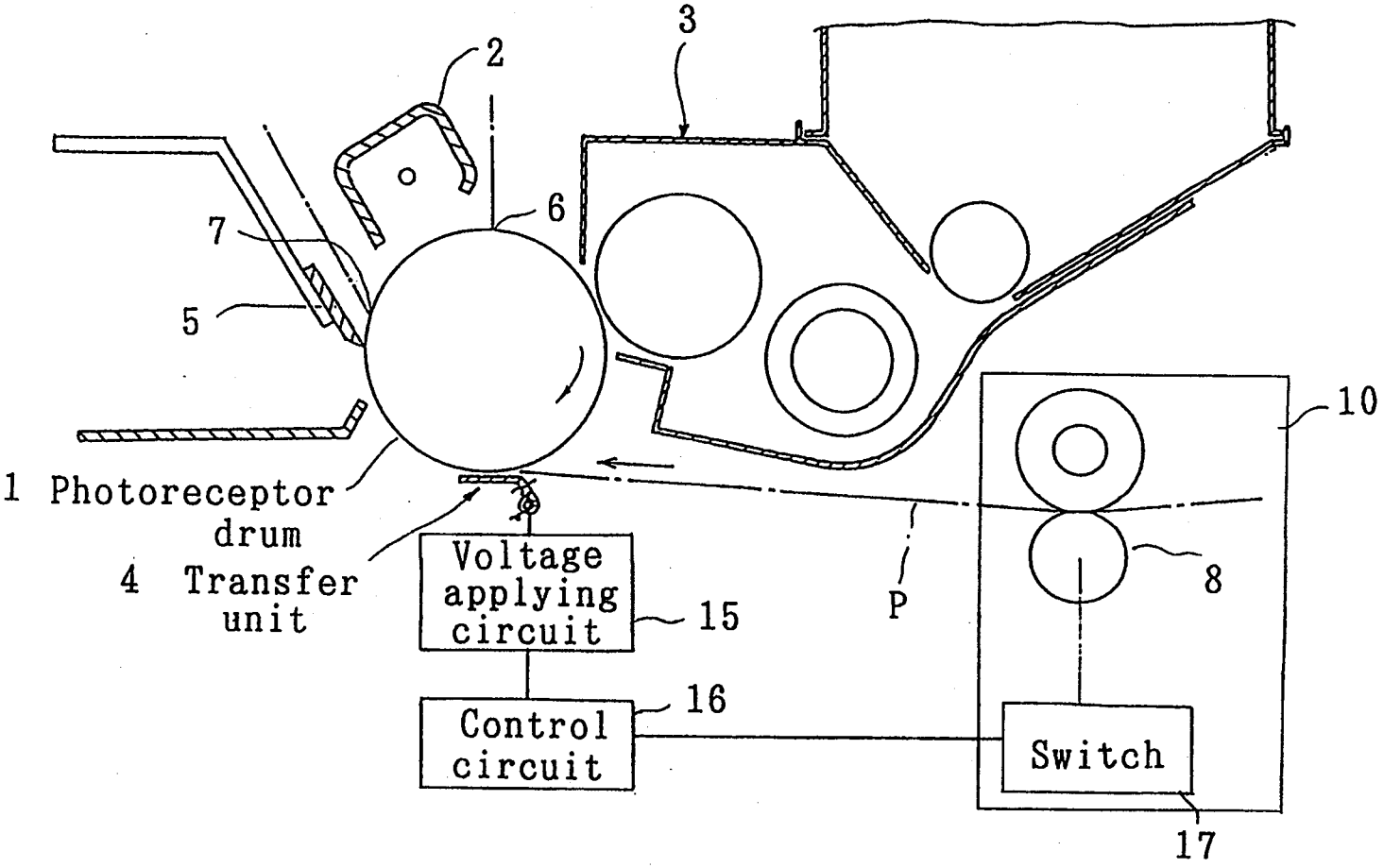
FIG. 3 is a vertical front section of a transfer unit embodying the present invention.
Figure 4:
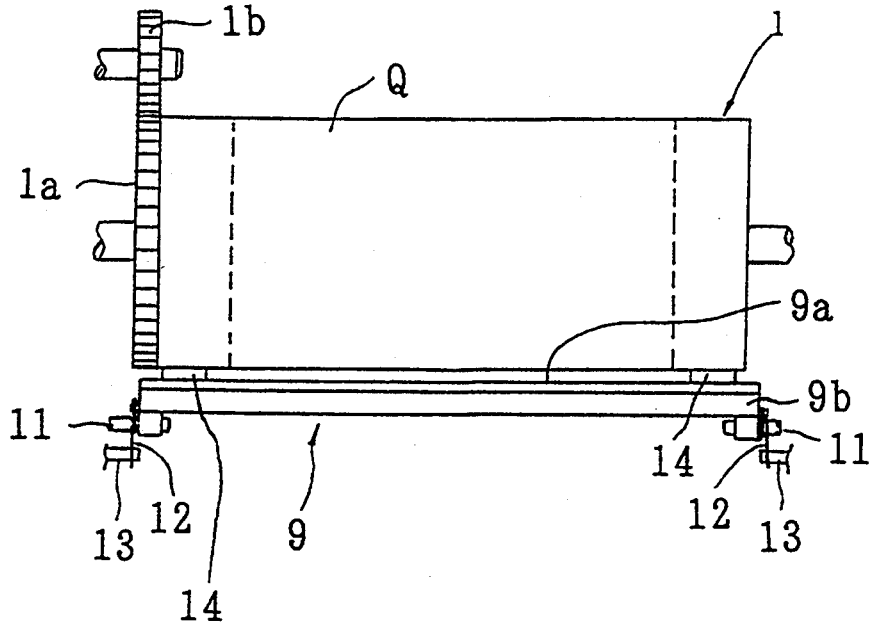
FIG. 4 is a schematic side view of a photoreceptor drum and a transfer mechanism of the transfer unit of FIG. 3.
Figure 5:
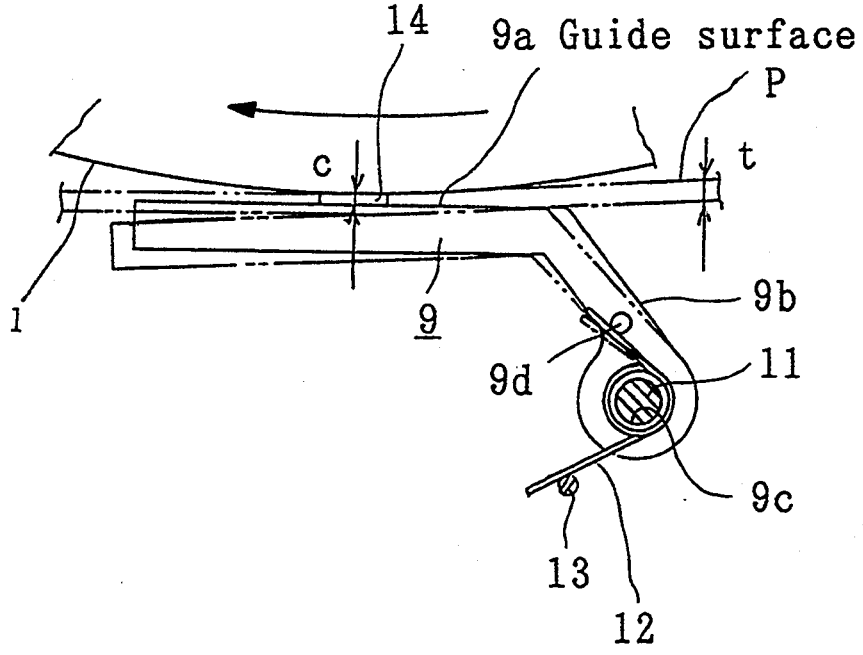
FIG. 5 is an enlarged front view of the transfer mechanism of the transfer unit of FIG. 3.

Referring to FIGS. 3 to 5, there is shown a transfer unit embodying the present invention. FIG. 3 shows a relevant portion of a copying apparatus incorporating the transfer unit of the present invention, wherein reference numeral 1 represents a photoreceptor drum which is rotated in one direction by a driving system (not shown) through a speed reducing mechanism constituted as shown in FIG. 4 by a gear 1*a* provided at one end of the photoreceptor drum and a pinion 1*b* mating with the gear 1*a*. The driving system has the pinion 1*b* as its output terminal.

Around the photoreceptor drum 1 are arranged a main charger 2 constituted by a corona discharger, a developer unit 3, a transfer unit 4 and a cleaning blade 5 in this order in a direction of rotation of the drum. An exposure portion 6 is provided between the main charger 2 and the developer unit 3. A charge removal portion 7 is provided between the cleaning blade 5 and the main charger 2. Reference numeral 8 represents a paper feeding roller for feeding a transfer sheet P to a gap between the drum 1 and the transfer unit 4. The roller 8 constitutes a part of a paper feeding unit 10.

In the copying apparatus of the above-described arrangement, the surface of the photoreceptor drum is charged through a corona discharge by the main charger 2. On the charged drum surface, an electrostatic latent image of an image read out from an original by an optical system (not shown) provided to the body of the copying apparatus is formed at the exposure portion 6. Then, charged toner is applied onto the electrostatic latent image by the developer unit 3 to form a toner image. While these operations are being performed, the transfer sheet P is fed into the gap between the drum 1 and the transfer unit 4 by the paper feeding unit 10. The toner image on the drum surface is transferred to the sheet P by the transfer unit 4 in a manner described later.

After the transfer, toner remaining on the drum surface is removed by the cleaning blade 5. Then, the drum surface is charge-removed by applying light thereto at the charge removal portion 7 to be ready for the next charging. The sheet P where the toner image is transferred is heated and pressurized by a fixing unit (not shown) provided to the body of the copying apparatuses to thereby fix the toner image on the sheet P.

FIG. 4 is a side view of the transfer unit 4. FIG. 5 is an enlarged view of the transfer unit 4. In this embodiment, as shown in these figures, the transfer unit 4 is provided with a transfer plate 9 which also serves as a guide plate for the sheet P.

The transfer plate 9 is made of, for example, a metallic material such as copper, aluminum and iron having an excellent conductivity or a conductive resin material admixed with carbon or conductive rubber. The upper surface thereof which serves as a guide surface, designated 9*a*, with which the sheet P is slidingly in contact is formed to be a flat surface which is long enough to cover an image formation area Q (the area between the dotted lines in FIG. 4). The transfer plate 9 is arranged in such manner that the guide surface 9*a* is closely opposite to the surface of the drum 1 below the drum 1.

At a front end portion of the transfer plate 9 in the paper feeding direction, an inclined surface 9*b* for guiding onto the guide surface 9*a* the sheet P conveyed from the paper feeding unit 10 is formed so as to extend from the guide surface 9*a*. At each side end portion of the inclined surface 9*b*, a hole 9*c* is formed. A fulcrum rod 11 horizontally fixed to the body of the copying apparatus is inserted into each of the holes 9*c* so that the transfer plate 9 is slightly pivotable upward and downward about the fulcrum rod 11.

Around each fulcrum rod 11, a torsion spring 12 is fitted which serves as a pushing means. One arm of the torsion spring 12 is caught by a protrusion 9*d* formed on the transfer plate 9, and the other arm thereof is caught by a protrusion 13 formed on the body of the copying apparatus. Thereby, the transfer plate 9 is always pushed up by the torsion spring 12 toward the drum surface. The resiliency of the torsion spring 12 is set such that the feeding of the sheet P into the gap between the drum 1 and the transfer unit 4 is not hindered.

As shown in FIG. 4, to each end portion of the guide surface 9*a* which faces a portion of the drum surface that is outside the image formation area Q, a spacer member 14 constituted by a plate strip slightly thinner than the Sheet P having a standard thickness t is attached as a gap maintaining means. When the transfer plate 9 is pushed up by the torsion spring 12, the spacer member 14 abuts the drum surface to prevent, against the pushing force of the torsion spring 12, the contact of the transfer plate 9 with the drum surface, and maintains a minimum gap c between the guide surface 9*a* and the drum surface to be smaller than the standard thickness t of the sheet P.

Specifically, the minimum gap c is maintained to be $0<c<t$ by the spacer member 14. While the standard thickness t of the sheet P is usually approximately 0.1 mm, some sheets have thicknesses of up to approximately 0.2 mm. In this embodiment, the resiliency of the torsion spring 12 is set such that such thicker transfer sheets can pass the transfer position of the drum 1. Instead of providing the spacer member 14, a step-like portion having a thickness corresponding to that of the member 14 may be formed at each side of the transfer plate 9.

Returning to FIG. 3, a voltage applying circuit 15 applies a transfer voltage to the transfer plate 9. A control circuit 16 controls the voltage applying circuit 15 in connection with an activation of a switch 17 provided to the paper feeding unit 10. The switch 17 is utilized in order to get a timing of paper feeding. In this embodiment, the paper feeding timing is set such that a transfer voltage is applied from the voltage applying circuit 15 to the transfer plate 9 before the sheet P is admitted into the gap between the transfer plate 9 and the drum surface. The application of the transfer voltage is continued for a predetermined period.

This arrangement operates in the following manner. While the sheet P is being conveyed from the paper feeding unit 10, the control circuit 16 senses an activation of the switch 17 to allow the voltage applying circuit 15 to output a voltage, thereby applying a transfer voltage of a polarity reverse to that of the charged toner on the drum 1. Thereafter, the sheet P is admitted into the gap between the drum surface and the guide surface 9a.

When the sheet P is admitted into the gap, the transfer plate 9 is pushed down against the pushing force of the torsion spring 12 by the sheet P since the gap between the guide surface 9a and the drum surface is smaller than the thickness of the sheet P. Simultaneously, the pushing force of the torsion spring 12 works on the sheet P through the transfer plate 9, so that the surface of the sheet P is brought into close contact with the toner on the drum surface with an appropriate pressure. Since the sheet P is in direct contact with the transfer plate 9 serving as a voltage applying electrode and is in close contact with the drum surface, the transfer voltage required is only a fraction of that required in the corona transfer method where transfer is performed with no contact. Specifically, in the case of the corona transfer method, approximately 5 to 6 kV is required, while in this embodiment, only approximately 1 kV is required to realize excellent image quality.

After the admission into the gap, the sheet P is conveyed by the rotating drum 1 in the direction of rotation thereof while being slidingly in contact with the guide surface 9a. At this time, the toner image on the drum 1 is transferred to the sheet P. After the sheet P has passed through the gap c, the transfer plate 9 is again pushed up toward the drum surface by the pushing force of the torsion spring 12 and is maintained at a position where the spacer member 14 abuts the drum 1, that is, where the minimum gap c which is smaller than the standard thickness t of the sheet P is left so that the guide surface 9a is out of contact with the drum surface. Since the transfer plate 9 and the drum surface are out of contact with each other when no sheet is present therebetween, the transfer plate 9 is never contaminated by toner remaining on the drum surface.

Figure 6:
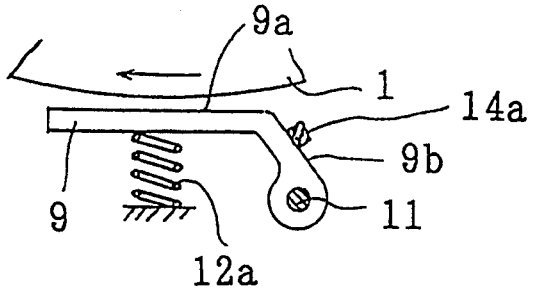
FIG. 6 is a schematic front view of a modification of each of a pushing means and a gap maintaining means of the transfer unit of FIG. 5.

Referring now to FIG. 6, there are shown modifications of the pushing means and the gap maintaining means. In the arrangement of this figure, instead of the torsion spring 12, a compression coil spring 12a is used as the pushing means. By the compression coil spring 12a arranged between a portion on the lower surface of the transfer plate 9 just below the transfer position on the drum surface and a fixing portion on the body of the copying apparatus, the transfer plate 9 is always pushed toward the drum surface.

As the gap maintaining means, instead of the spacer member 14 or the step-like portion, a stopper member 14a is used which is fixed to a portion on the body of the copying apparatus. The stopper member 14a abuts the inclined surface 9b of the transfer plate 9. The position of the stopper member 14a is set such that the minimum gap c is left between the guide surface 9a and the drum surface when the stopper member 14a abuts the inclined surface 9b to prevent the transfer plate 9 from being further pivoted upward. In FIG. 6, the same elements as those of the previously-described embodiment are identified by the same reference designations and a description thereof will not be given.

Figure 7:
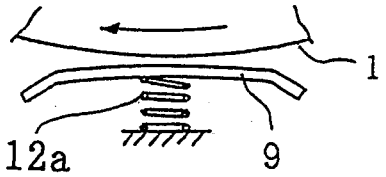
FIG. 7 is a schematic front view of another modification of the pushing means.

In this embodiment, the transfer plate 9 may be, for example, an arc as shown in FIG. 7. In this case, the compression coil spring 12a is arranged just below the transfer position of the drum 1. With this arrangement, when the transfer position is a line along a generating line on the drum surface which is closest to the arcing transfer plate 9, the transfer plate 9 always pushes the sheet P with an appropriate pressure irrespective of the thickness of the sheet P. In FIG. 7, the same elements as those of the previously-described embodiment are identified by the same reference designations and a description thereof will not be Given.

Figure 8:
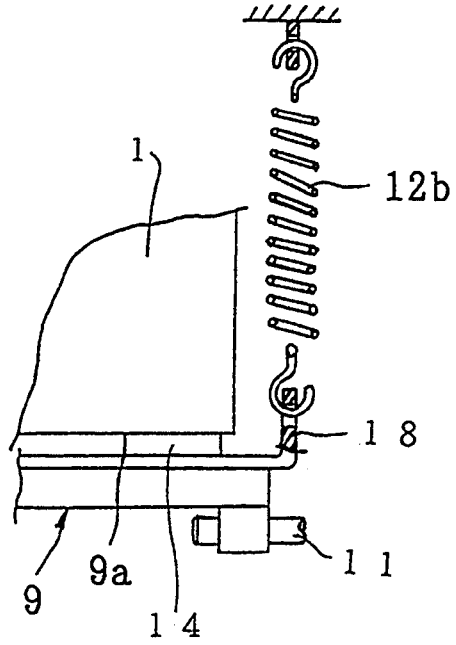
FIG. 8 is an enlarged schematic side view of still another modification of the pushing means.

Further, in an arrangement where the spacer member 14 is provided on the guide surface 9a as a gap maintaining means as in the above-described embodiment, a tension spring 12b as shown in FIG. 8 may be used as a pushing means instead of the torsion spring 12 or the compression coil spring 12a. In this case, spring holders 18 are formed at both sides of the transfer plate 9 (only one side is shown in FIG. 8), and the tension spring 12b is extended between the spring holder 18 and a spring holder formed at the body side to pull the transfer plate 9 toward the drum surface.

While the present invention is employed in a copying apparatus using a rotating-drum-type photoreceptor in the above-described embodiments, it will be appreciated that the present invention may be employed in copying apparatuses having photoreceptor of other types such as an endless belt type.

As described above, according to the present invention, the guide plate also serves as a transfer plate since a transfer voltage is directly applied to a sheet guide plate for guiding a transfer sheet to a transfer position on the photoreceptor drum, the transfer plate is always pushed toward the drum surface by the pushing means, and a gap which is smaller than the thickness of the sheet is maintained between the drum surface and the transfer plate so that the two are out of contact. For these reasons, neither corona discharger nor conductive roller requiring large spaces, nor roller cleaning unit is necessary. Further, since the transfer plate is pressed onto the transfer sheet during transferring, the path through which the sheet passes may be small. As a result, in the case where the transfer unit is arranged below the photoreceptor drum, the vertical size of the apparatus is largely reduced. For the reasons described above, according to the present invention, a small-sized copying apparatus is effectively realized.

Obviously, many modifications and variations of the present invention are possible in light of the above teachings. It is therefore to be understood that within the scope of the appended claims, the invention may be practiced other than as specifically described.

What is claimed is:

1. A transfer unit for transferring to a transfer sheet a toner image formed on a surface of a photoreceptor, said transfer unit comprising:

a transfer plate including a guide surface, said guide surface being in contact with a transfer sheet fed in one direction slidingly thereover, said transfer plate being disposed so that said guide surface is opposite to a surface of the photoreceptor;

pushing means for continuously urging said transfer plate toward the photoreceptor, whereby a transfer sheet is brought into contact with the surface of the photoreceptor;

gap maintaining means for maintaining a minimum gap between said transfer plate and the surface of the photoreceptor in the absence of a transfer sheet, said minimum gap being less than 0.2 mm, whereby contact of a transfer sheet with the surface of the photoreceptor is maintained irrespective of transfer sheet thickness; and voltage supplying means for supplying a transfer voltage to said transfer plate when a transfer sheet passes through said gap between said transfer plate and the surface of the photoreceptor.

2. A transfer unit according to claim 1, wherein pivotable supporting means is provided for pivotably supporting one end of said transfer plate.

3. A transfer unit according to claim 2, wherein said pivotable supporting means has a hole formed at the one end of said transfer plate and a rod inserted in said hole, said rod being horizontally fixed to a body of an image forming apparatus incorporating said transfer unit.

4. A transfer unit according to claim 3, wherein said pushing means is a torsion spring disposed around said rod, one end of said torsion spring urging said transfer plate and another end of said torsion spring being secured by the body of the image forming apparatus.

5. A transfer unit according claim 1, wherein said transfer plate includes a flat surface arranged so as to be facing opposite the surface of the photoreceptor, and said transfer plate further includes an inclined surface extending from said flat surface, said inclined surface guiding a transfer sheet conveyed thereto toward the flat surface.

6. A transfer unit according to claim 1, wherein said transfer plate is made of a conductive material.

7. A transfer unit according to claim 1, wherein said transfer plate is made of a conductive resin material.

8. A transfer unit according to claim 1, wherein said transfer plate is made of a conductive rubber material.

9. A transfer unit according to claim 1, wherein said gap maintaining means is provided on said transfer plate and abuts a portion of the surface of the photoreceptor which is outside an image formation area of the photoreceptor.

10. A transfer unit according to claim 1, wherein said pushing means is a compression coil spring for urging said transfer plate toward the photoreceptor.

11. A transfer unit according to claim 1, wherein said gap maintaining means is a stopper member fixed to an image forming apparatus.

12. A transfer unit according to claim 1, wherein said pushing means is a compression coil spring and wherein said transfer plate is fixed to one end of said compression coil spring so as to urge said transfer plate toward the photoreceptor.

13. A transfer unit according to claim 1, wherein said pushing means is a tension spring fixed to an image forming apparatus at one end and wherein said gap maintaining means is provided on the transfer plate and abuts a portion of the surface of the photoreceptor which is outside an image formation area of the photoreceptor.

* * * * *